US006314260B1

(12) United States Patent
Watanabe

(10) Patent No.: US 6,314,260 B1
(45) Date of Patent: Nov. 6, 2001

(54) VAPOR CAPTURE SUBSYSTEM AND METHOD THEREOF

(75) Inventor: Toshimi Watanabe, Yamagata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/552,417

(22) Filed: Apr. 19, 2000

(30) Foreign Application Priority Data

Apr. 23, 1999 (JP) ..... 11-117117

(51) Int. Cl.[7] ..... G03G 15/10
(52) U.S. Cl. ..... 399/250
(58) Field of Search ..... 399/249–251

(56) References Cited

U.S. PATENT DOCUMENTS

| | | | | |
|---|---|---|---|---|
| 5,552,869 | * | 9/1996 | Schilli et al. | 399/251 |
| 5,737,674 | * | 4/1998 | Venkatesan et al. | 399/250 |
| 5,884,128 | * | 3/1999 | Park | 399/250 |
| 5,905,928 | * | 5/1999 | Shin | 399/250 |
| 5,940,666 | * | 8/1999 | Han | 399/249 |
| 6,064,851 | * | 5/2000 | Saitoh | 399/249 X |
| 6,085,055 | * | 7/2000 | Shin et al. | 399/250 |
| 6,101,356 | * | 8/2000 | Kim et al. | 399/250 |
| 6,141,518 | * | 10/2000 | Shin et al. | 399/250 |

FOREIGN PATENT DOCUMENTS

| | | |
|---|---|---|
| 8-166721 | 6/1996 | (JP) . |
| 8-166722 | 6/1996 | (JP) . |
| 11-73024 | 3/1999 | (JP) . |
| 11-184260 | 7/1999 | (JP) . |
| 11-184344 | 7/1999 | (JP) . |
| 11-282256 | 10/1999 | (JP) . |
| 11-327402 | 11/1999 | (JP) . |
| 11-344868 | 12/1999 | (JP) . |

* cited by examiner

*Primary Examiner*—William J. Royer
(74) *Attorney, Agent, or Firm*—Ostrolenk, Faber, Gerb & Soffen, LLP

(57) ABSTRACT

A vapor capture subsystem, which improves capturing efficiency of a carrier solvent, is provided. The vapor capture subsystem provides a ring shaped drying belt which absorbs the carrier solvent in a developing material that is developed on the surface of an organic photoconductor belt by a developer, a regeneration roller which makes the carrier solvent absorbed at the ring shaped drying belt vapor, a condenser which captures the carrier solvent vaporized at the regeneration roller and makes the vaporized carrier solvent liquid by cooling, tubes which lead the carrier solvent vaporized at the regeneration roller to the condenser, an air pump which leads the carrier solvent vaporized at the regeneration roller to the condenser, and a manifold which covers one end side of the ring shaped drying belt and the regeneration roller in order that the vapor generated at the regeneration roller does not leak to the outside. The capturing efficiency at the manifold can be increased by making the drying temperature at the regeneration roller 85° C. or more, and making the sucking air quantity of the air pump 22 to 45 liters/minute.

44 Claims, 9 Drawing Sheets

VAPOR CAPTURE SUBSYSTEM AND METHOD THEREOF

BACKGROUND OF THE INVENTION

The present invention relates to a vapor capture subsystem and method thereof, in which liquid is captured from a place by making the liquid vapor, and further the vapor is made to be liquid again and returned to the original place.

DESCRIPTION OF THE RELATED ART

An image forming apparatus using electrophotography provides a vapor capture subsystem, in which liquid is captured from a place and is made to be vapor, and further the vapor is made to be liquid again and returned to the original place.

A developing material (ink) consists of toners being solid particles, a solvent including carrier electrons (hereinafter referred to as a carrier solvent), and other substances. The ink made to be visible on an organic photoconductor surface can not be transferred to a paper, when the solvent remains. In this, the organic photoconductor is also called an organic photo-rayer. In order to transfer the ink, it is necessary that only the solid particles are made to remain on the organic photoconductor surface selectively, and the unnecessary solvent is removed, and an image must be formed in filming. This function is performed by a vapor capture subsystem.

When an image is transferred to a paper at an image forming apparatus using a carrier solvent, capturing, all the carrier solvent thoroughly is an important subject to achieve a high quality image and also to reuse the carrier solvent.

As a first example of the conventional technology Japanese Patent Application Laid-Open No. HEI 8-166721 discloses a carrier solvent vapor capture subsystem for a liquid image forming apparatus. This conventional carrier solvent vapor capture subsystem for a liquid image forming apparatus provides a liquefying means for liquefying captured carrier solvent vapor, a separating means for separating the liquid made through the liquefying means into the carrier solvent and water, and a cooling equipment having fins for cooling provided at a route which the captured carrier solvent vapor passes through. And at least a part of the surface of the fin is made of a material which is difficult to be gotten wet by the carrier solvent.

As a second example of the conventional technology, Japanese Patent Application Laid-Opcn No. HEI 8-166722 discloses a carrier solvent vapor capture subsystem for a liquid image forming apparatus and a liquid image forming apparatus using this subsystem. This conventional carrier solvent vapor capture subsystem for a liquid image forming apparatus provides a vapor capturing chamber where a part such as a fuser, in which the carrier solvent vapor is liable to rise, is covered by a covering component and is made to be an airtight structure, a vapor drain from the vapor capturing chamber to a vapor liquefying means, a vapor liquefying means for liquefying the carrier solvent vapor captured through the vapor drain, a separating means for separating the liquid made through the liquefying means into the carrier solvent and water, and an air current generator which is at a route through which the carrier solvent vapor passes and at a downstream position from the vapor liquefying means.

However, the first example mentioned above only describes that the vapor capturing is performed smoothly. And the second example mentioned above only describes that high liquefying efficiency is performed. And they do not disclose a concrete means to improve the capturing efficiency of the carrier solvent.

SUMMARY OF THE INVENTION

It is therefore an object of the present invention to provide a vapor capture subsystem and a method thereof, in which capturing efficiency of a carrier solvent is improved.

According to a first embodiment of the present invention, for achieving the object mentioned above, there is provided a vapor capture subsystem. The vapor capture subsystem provides an absorbing means for absorbing a carrier solvent in a developing material that is developed on the surface of an organic photoconductor belt by a developer, a vaporizing means for vaporizing the carrier solvent absorbed at the absorbing means, a cooling means which captures the carrier solvent vaporized by the vaporizing means and makes the vaporized carrier solvent liquid by cooling, tube components which lead the carrier solvent vaporized by the vaporizing means to the cooling means, a sucking means which leads the carrier solvent vaporized by the vaporizing means to the cooling means, and a covering component which covers one end side of the absorbing means and the vaporizing means in order that the vapor generated by the vaporizing means does not leak to the outside.

Preferably, the drying temperature of the vaporizing means is made to be 85° C. or more, and the air sucking quantity of the sucking means is made to be 22 to 45 liters/minute, most preferably 22 to 38 liters/minute.

Additionally, the number of the tube components is preferably four to twelve pieces, and the inside diameter of the tube components is preferably seven to twelve mm.

Preferably, the covering component is made of a heat-resistant resin material and the heat-resistant resin material is preferably polycarbonate or polyethylene terephthalate.

In a preferred embodiment, the absorbing means is a ring shaped drying belt whose one end contacts the organic photoconductor belt, the vaporizing means is a regeneration roller which is provided at the opposite side of the position where the ring shaped drying belt contacts the organic photoconductor belt, and contacts the inside surface of the ring shaped drying belt. In this preferred embodiment, the covering component has an opening pair at the side where the ring shaped drying belt contacts the organic photoconductor belt, and is provided in a state that a designated interval exists between the outside surface of the ring shaped drying belt and the inside surface of the covering component in order to provide routes through which outside air from said opening par passes. The capacity of a first route provided on the outside surface of the upper side of the ring shaped drying belt is, in this embodiment, preferably larger than the capacity of a second route provided on the outside surface of the lower side of the ring shaped drying belt. The covering component has preferably has an air outlet at the vertical under position of the regeneration roller, and the vapor sucked by the sucking means is outputted from the air outlet.

Further, the covering component is preferably provided in a state that the ratio of inputting air quantity of the first route to the addition of the inputting air quantities of the first and second routes is 40 to 60%.

According to a second embodiment of the present invention, a vapor capture subsystem provides an absorbing means for absorbing a carrier solvent in a developing material that is developed on the surface of an organic photoconductor belt by a developer, a vaporizing means for vaporizing the carrier solvent absorbed at the absorbing means, a cooling means which captures the carrier solvent vaporized by the vaporizing means and makes the vaporized carrier solvent liquid by cooling, tube components which lead the carrier solvent vaporized by the vaporizing means to the cooling means, a sucking means which leads the carrier solvent vaporized by the vaporizing means to the cooling means, and a covering component which covers one end side of the absorbing means and the vaporizing means such that the vapor generated by the vaporizing means does not leak to the outside. Preferably, the number of the tube components is four to twelve pieces, and the inside diameter of the tube components is seven to twelve mm.

Preferably, in the second embodiment, the covering component is made of a heat-resistant resin material and the heat-resistant resin material is polycarbonate or polyethylene terephthalate.

In this second embodiment, preferably, the absorbing means is a ring shaped drying belt whose one end contacts with the organic photoconductor belt, the vaporizing means is a regeneration roller which is provided at the opposite side of the position where the ring shaped drying belt contacts the organic photoconductor belt and the inside surface of the ring shaped drying belt. Preferably, the covering component has an opening part at the side where the ring shaped drying belt contacts the organic photoconductor belt, and is provided such that a designated interval exists between the outside surface of the ring shaped drying belt and the inside surface of the covering component in order to provide routes through which outside air from the opening part passes, the capacity of a first route provided on the outside surface of the upper side of the ring shaped drying belt is larger than the capacity of a second route provided on the outside surface of the lower side of the ring shaped drying belt. Preferably, the covering component has an air outlet at the vertical under position of the regeneration roller and the vapor sucked by the sucking means is outputted from the air outlet.

Alternatively, the covering component can be provided such that the ratio of inputting air quantity of the first route to the addition of the inputting air quantities of the first and second routes is 40 to 50%.

In a further embodiment, a vapor capture subsystem provides an absorbing means for absorbing a carrier solvent in a developing material that is developed on the surface of an organic photoconductor belt by a developer, a vaporizing means for vaporing the carrier solvent absorbed at the absorbing means, a cooling means which captures the carrier solvent vaporized by the vaporizing means and makes the vaporized carrier solvent liquid by cooling, tube components which lead the carrier solvent vaporized by the vaporizing means to the cooling means, a sucking means which leads the carrier solvent vaporized by the vaporizing means to the cooling means, and a covering component which covers one end side of the absorbing means and the vaporizing means such that the vapor generated by the vaporizing means does not leak to the outside. Preferably, the covering component is made of a heat-resistant resin material and the heat-resistant resin material is polycarbonate or polyethylene terephthalate.

In this further embodiment, preferably, the absorbing means is a ring shaped drying belt whose one end contacts the organic photoconductor belt, the vaporizing means is a regeneration roller which is provided at the opposite side of the position where the ring shaped drying belt contacts the organic photoconductor belt and contacts the inside surface of the ring shaped drying belt the covering component has an opening part at the side where the ring shaped drying belt contacts the organic photoconductor belt is provided such that a designated interval exists between the outside surface of the ring shaped drying belt and the inside surface of the covering component in order to provide routes through which outside air from the opening part passes, and the capacity of a first route provided on the outside surface of the upper side of the ring shaped drying belt is larger than the capacity of a second route provided on the outside surface of the lower side of said ring shaped drying belt. Preferably, the covering component has an air outlet at the vertical under position of the regeneration roller the vapor sucked by the sucking means is outputted from the air outlet, and the covering component is provided such that the ratio of inputting air quantity of the first route to the addition of the inputting air quantities of the first and second routes is 40 to 50%.

According to yet another embodiment of the present invention, a vapor capture subsystem provides a ring shaped drying belt whose one end contacts with an organic photoconductor belt and absorbs a carrier solvent in a developing material that is developed on the surface of the organic photoconductor belt by a developer, a regeneration roller which is provided at the opposite side of the position where the ring shaped drying belt contacts the organic photoconductor belt, contacts the inside surface of the ring shaped drying belt, and makes the carrier solvent absorbed at the ring shaped drying belt vapor. The system further includes a condenser which captures the carrier solvent vaporized at the regeneration roller and makes the vaporized carrier solvent liquid by cooling, tubes which lead the carrier solvent vaporized at the regeneration roller to the condenser, an air pump which leads the carrier solvent vaporized at the regeneration roller to the condenser, and a manifold which has an opening part at the side where the ring shaped drying belt contacts the organic photoconductor belt, and is provided such that a designated interval exists between the outside surface of the ring shaped drying belt and the inside surface of the manifold in order to provide routes through which outside air from the opening part passes, and the capacity of a first route provided on the outside surface of the upper side of said ring shaped drying belt is larger than the capacity of a second route provided on the outside surface of the lower side of the ring shaped drying belt. Preferably, the manifold has an air outlet at the vertical under position of the regeneration roller, the vapor sucked by the air pump is, outputted from the air outlet and the manifold is provided such that the ratio of inputting air quantity of the first route to the addition of the inputting air quantities of the first and second routes is 40 to 50%.

In still a further embodiment of the present invention, a vapor capture method in an image forming apparatus provides the steps of absorbing a carrier solvent in a developing material that is developed on the surface of an organic photoconductor belt by a developer, vaporizing the carrier solvent absorbed at the absorbing step, sucking the carrier solvent vaporized at the vaporizing step and leading to a cooling step, and cooling the vaporized carrier solvent sucked at the sucking step and making the vaporized carrier solvent liquid by cooling. Preferably, the drying temperature of the vaporizing step is made to be 85° C. or more, the air sucking quantity of the sucking step is made to be 22 to 45 liters/minute, most preferably, 22 to 38 liters/minute.

Preferably, the number and the inside diameter of the tube components, which lead the carrier solvent vaporized at the vaporizing step to the cooling step, is four to twelve pieces and seven to twelve mm respectively.

In still another embodiment of the present invention, a vapor capture method in an image forming apparatus provides the steps of; absorbing a carrier solvent in a developing material that is developed on the surface of an organic photoconductor belt by a developer, vaporizing the carrier solvent absorbed at the absorbing step, sucking the carrier solvent vaporized at the vaporizing step and leading to a cooling step, and cooling the vaporized carrier solvent sucked at the sucking step and making the vaporized carrier solvent liquid by cooling. In this embodiment, preferably, the number and the inside diameter of tube components, which lead the carrier solvent vaporized at the vaporizing step to the cooling step, is four to twelve pieces and seven to twelve mm respectively.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
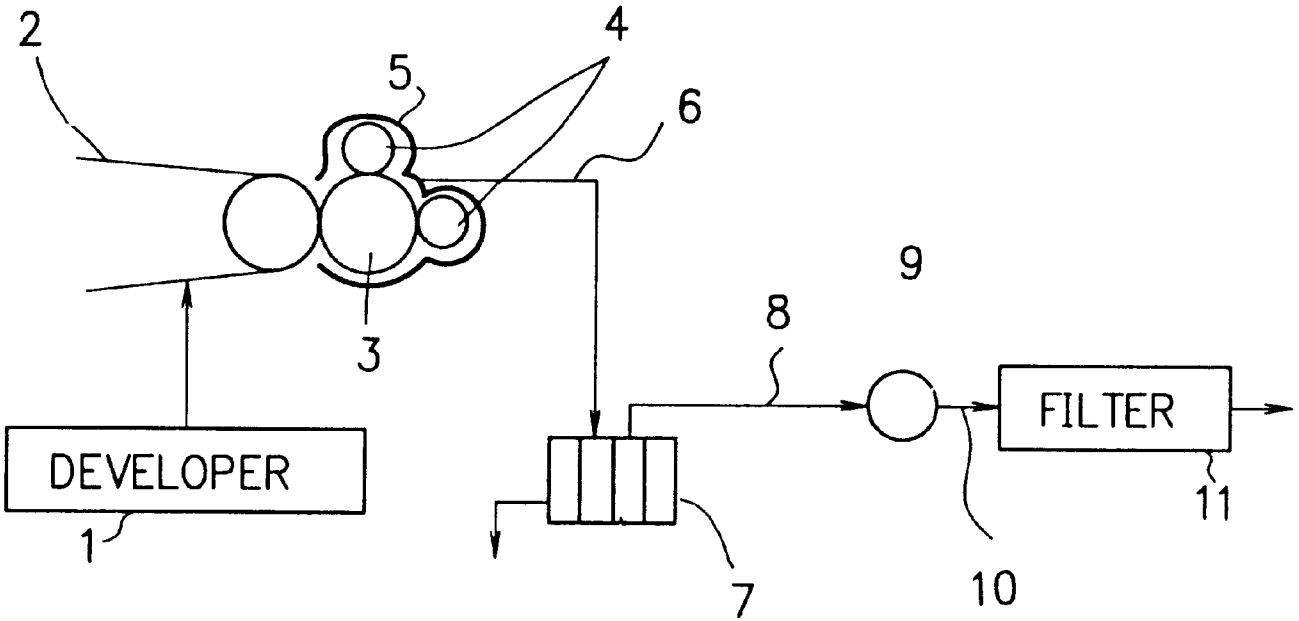
FIG. 1 is a block diagram showing a structure of an embodiment of an image forming apparatus using a vapor capture subsystem of the present invention.

Referring now to the drawings, embodiments of the present invention are explained in detail. FIG. 1 is a block diagram showing a structure of an embodiment of an image forming apparatus using a vapor capture subsystem of the present invention.

As shown in FIG. 1, the image forming apparatus using the vapor capture subsystem of the present invention consists of a developer 1 which develops a developing material on a surface of an organic photoconductor belt 2, the organic photoconductor belt 2 in which the developing material is developed on the surface by the developer 1, a drying roller 3 which absorbs a carrier solvent in the developing material, regeneration rollers 4 which change liquid to gas by applying heat to the carrier solvent absorbed by the drying roller 3, a manifold 5 which covers the drying roller 3 and the regeneration rollers 4 and captures the carrier solvent changed to vapor at the regeneration rollers 4, a condenser 7 which captures vapor generated in the manifold 5 and condenses the vapor to liquid by cooling the vapor, an air pump 9 which leads the vapor in the manifold 5 to the condenser 7, a filter 11 which removes the carrier solvent included in the vapor not captured by the condenser 7, first tubes 6 which connect the manifold 5 to the condenser 7, a second tube 8 which connects the condenser 7 to the air pump 9, and a third tube 10 which connects the output side of the air pump 9 to the filter 11.

Figure 2:
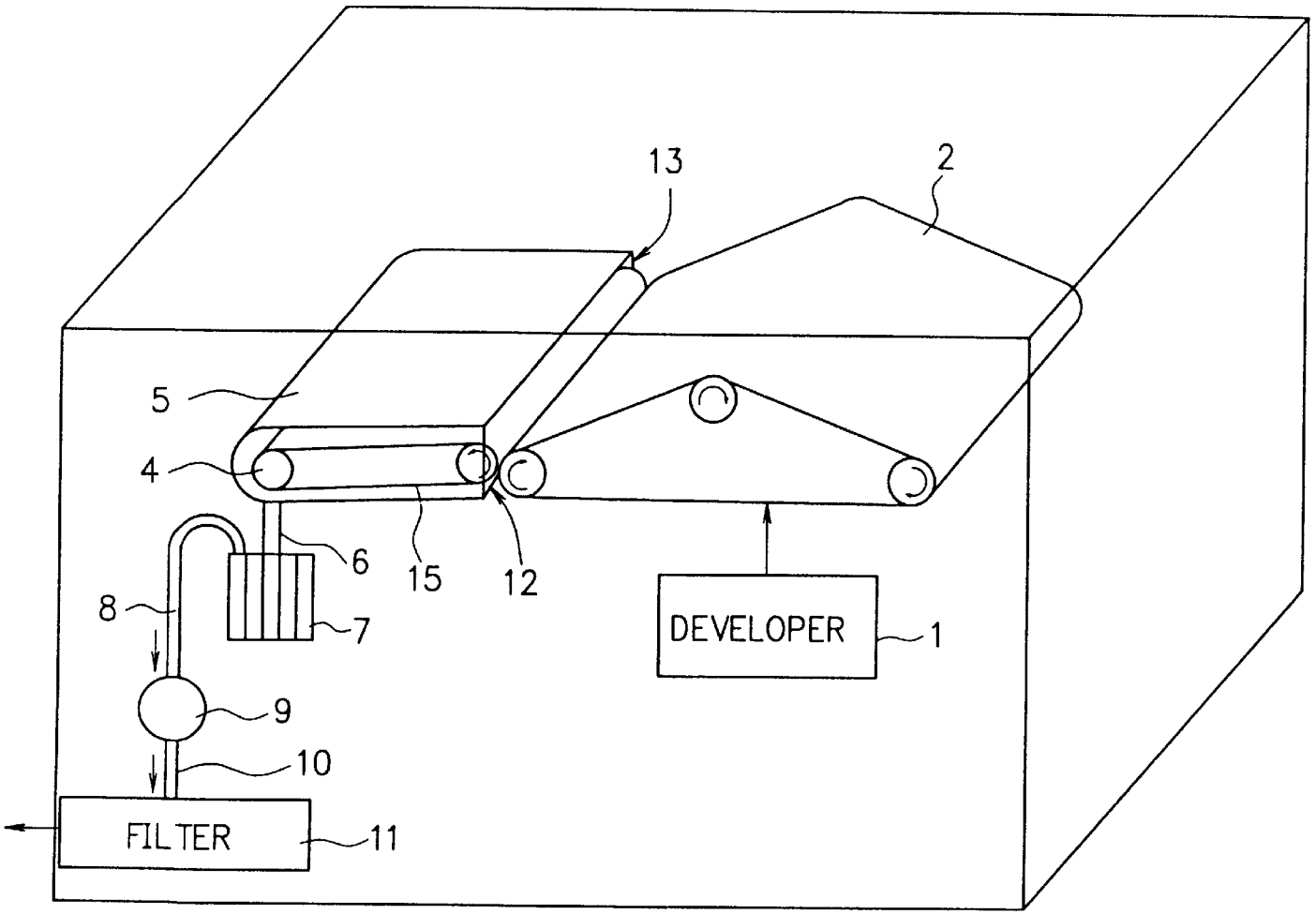
FIG. 2 is a block diagram showing a structure of another embodiment of an image forming apparatus using the vapor capture subsystem of the present invention.

FIG. 2 is a block diagram showing a structure of another embodiment of an image forming apparatus using the vapor capture subsystem of the present invention. As shown in FIG. 2, a ring shaped drying belt 15 is using instead of the drying roller 3 used in FIG. 1. The ring shaped drying belt 15 absorbs a carrier solvent in the developing material on the organic photoconductor belt 2.

Figure 3:
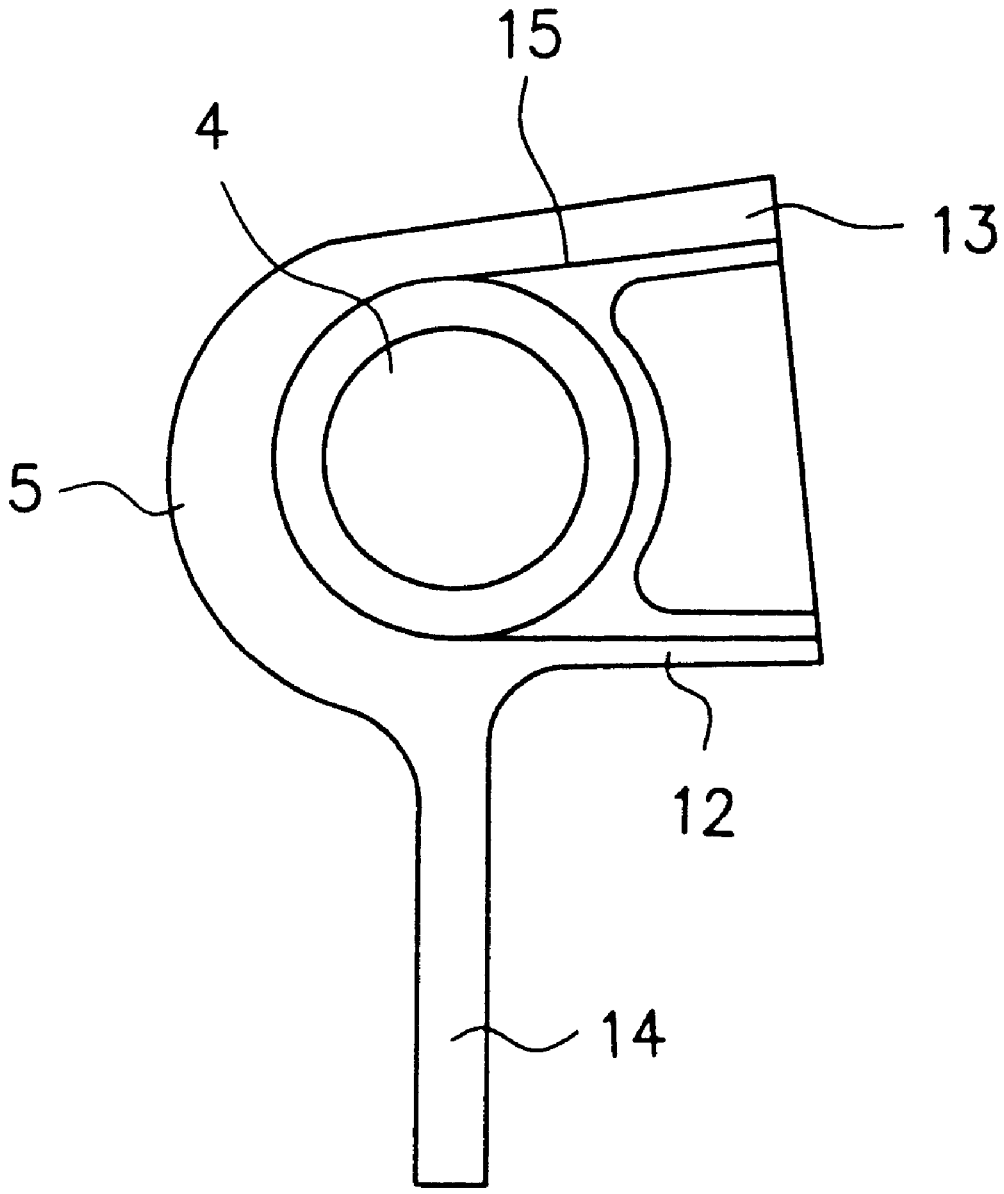
FIG. 3 is a diagram enlarging the part of a regeneration roller 30 and a manifold in FIG. 2.

FIG. 3 is a diagram enlarging the pair of the regeneration roller 4 and the manifold 5 in FIG. 2. As shown in FIG. 3, the manifold 5 is provided in a state that the manifold 5 covers the regeneration roller 4 so that the vapor generated at the regeneration roller 4 does not leak. And the manifold 5 provides air inlets 12 and 13 from which air is inputted, and an air outlet 14 as shown in FIG. 3. The carrier solvent vaporized at the regeneration rollers 4 is sucked by the air pump 9 and is drained to the outside of the manifold 5 from this air outlet 14.

Next, an operation of the image forming apparatus used the vapor capture subsystem of the present invention is explained. First, a developing material is developed on the surface of the organic photoconductor belt 2 by the developer 1. The developing material is transferred by the organic photoconductor belt 2, and the ring shaped drying belt 15 absorbs a carrier solvent in the developing material. Further, the carrier solvent is absorbed by the regeneration roller 4 and is heated and dried, and is changed from liquid to vapor. The ring shaped drying belt 15 and the regeneration roller 4 are covered with the manifold 5, vapor generated in the manifold 5 is captured at the condenser 7 and cooled. In this, the carrier solvent is changed to liquid from vapor. The liquid outputted from the condenser 7 is sucked by the air pump 9 via the second tube 8, and further goes to the filter 11 via the third tube 10, and is outputted to the outside of the apparatus. The air pump 9 generates the total air flow in this apparatus.

Figure 4:
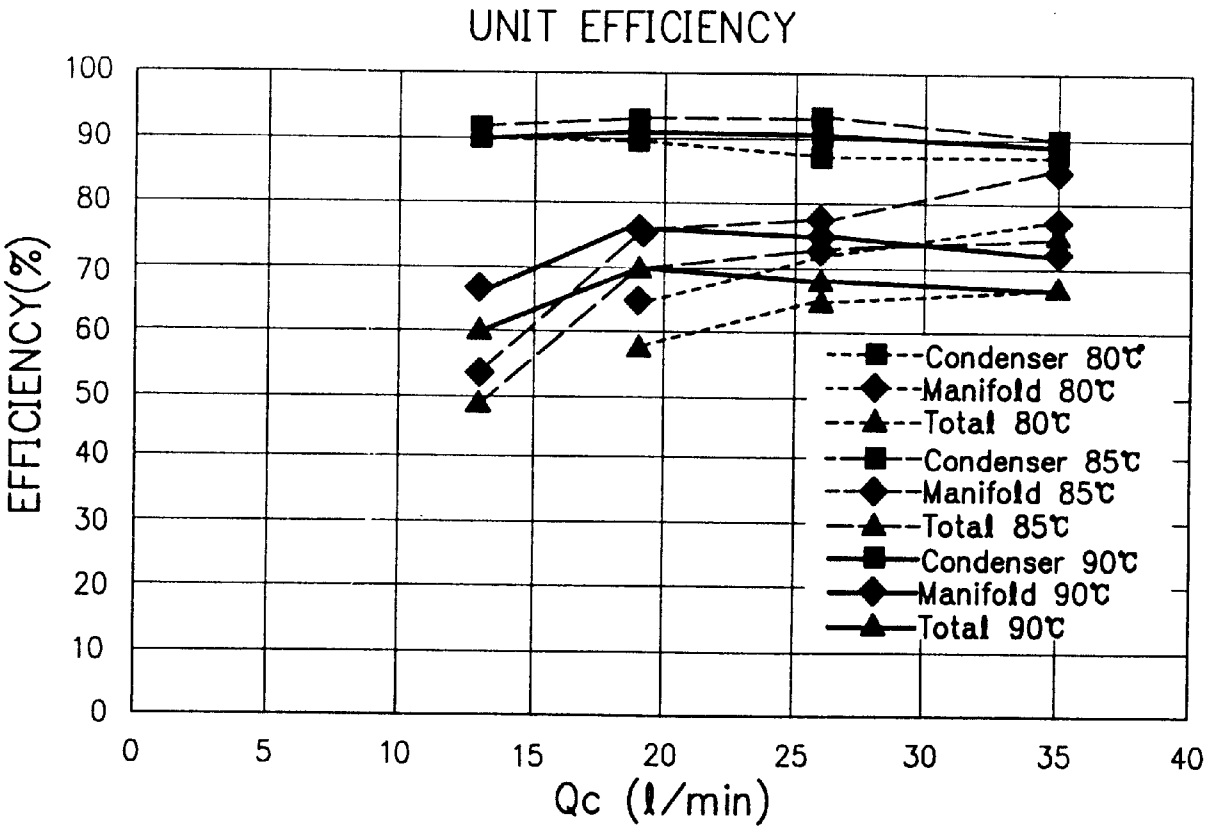
FIG. 4 is a graph showing a relation between an air flow quantity through an air pump and capturing efficiency at the manifold, capturing efficiency at a condenser, and total capturing efficiency where no improvement is applied to the vapor capture subsystem.

FIG. 4 is a graph showing a relation between the air flow quantity through the air pump and the capturing efficiency at the manifold, the capturing efficiency at the condenser, and the total capturing efficiency where no improvement is applied to the vapor capture subsystem. As shown in FIG. 4, the total efficiency does not reach 80% at the drying temperature 85° C.

In order to increase the capturing efficiency at the manifold 5, the capturing efficiency at the condenser 7, and the total capturing efficiency integrating these two efficiencies compared with the conventional vapor capture subsystem, the vapor capture subsystem of the present invention achieved the following improvements.

First, the temperature of the regeneration rollers 4 and the air flow quantity of the air pump 9 are explained. When the amount of the supplying carrier solvents is decided to be a designated value, the amount of heat needed to generate vapor is decided, and the air flow quantity needed to transport the vapor is also decided. The capturing volume of the carrier solvents Nv is a function of the air flow quantity Qc, the vapor concentration Cs, and the drying temperature T. And the capturing efficiency is improved by optimizing these factors. That is, the Nv is expressed in an equation (1).

$$Nv=f(Qc,Cs,T) \quad (1)$$

Figure 5:
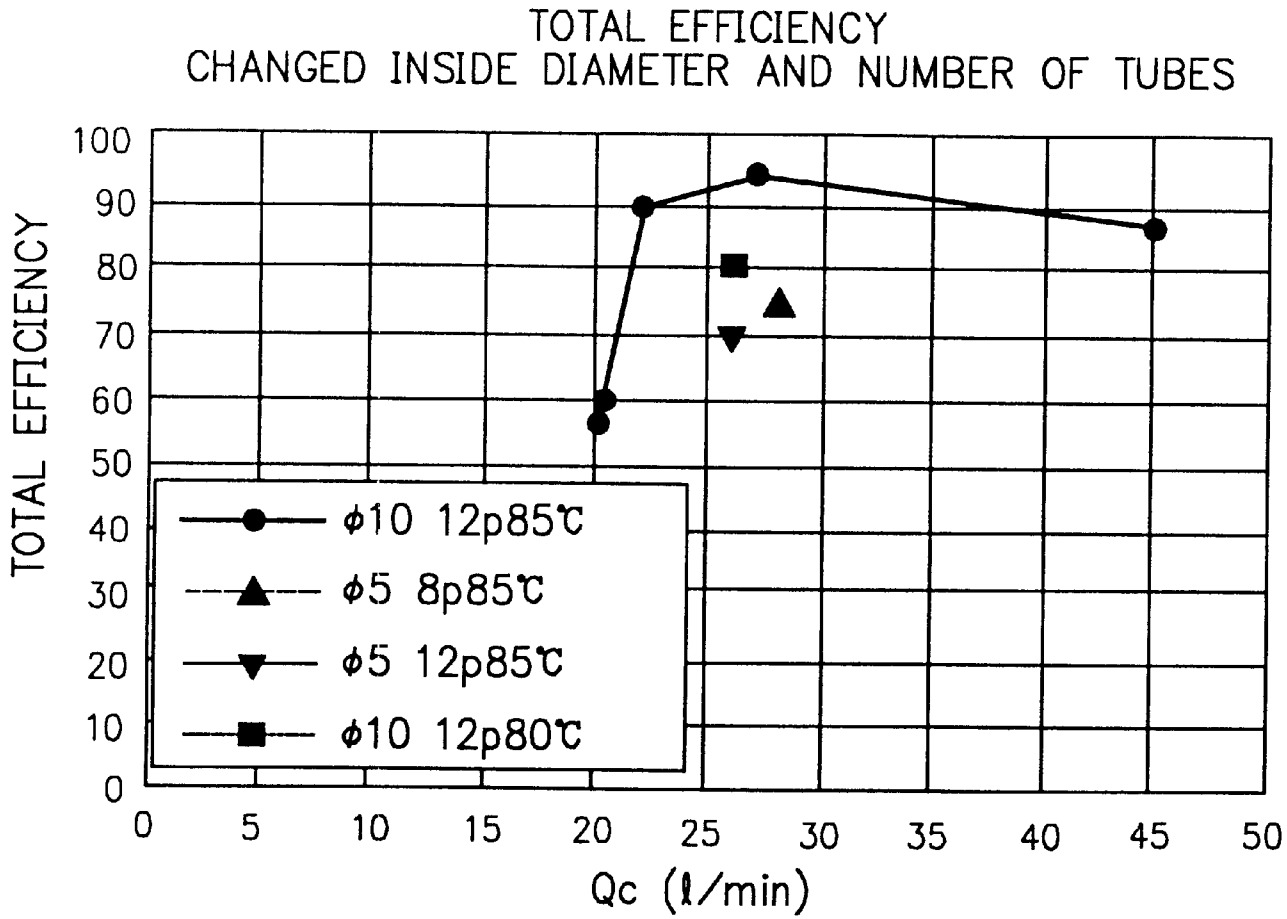
FIG. 5 is a graph showing the total capturing efficiency and the air flow quantity at the vapor capture subsystem of the present invention, in the conditions that the drying temperature is changed and the inside diameter and number of first tubes arc changed.

FIG. 5 is a graph showing the total capturing efficiency and the air flow quantity at the vapor capture subsystem of the present invention, in the conditions that the drying temperature at the regeneration roller 4 is 80 and 85° C. and the inside diameter and number of the first tubes 6 are changed. According to the relation mentioned above equation (1), for example, in case that the supplying amount of the carrier solvents is 900 mg/minute and the drying temperature is 85° C., as shown in FIG. 5, at the air flow quantity 22 to 38 liters/minute, the total capturing efficiency were able to achieve the value more than 90%. And even at that the air flow quantity is 38 to 45 liters/minute, the total capturing efficiency achieved the value more than 86%. In this, the more the air flow quantity, the more the capturing efficiency at the manifold. However, in case that the air flow quantity is more than 27 liters/minute, the leaked vapor amount from the condenser increases and the condenser efficiency becomes low.

Figure 6:
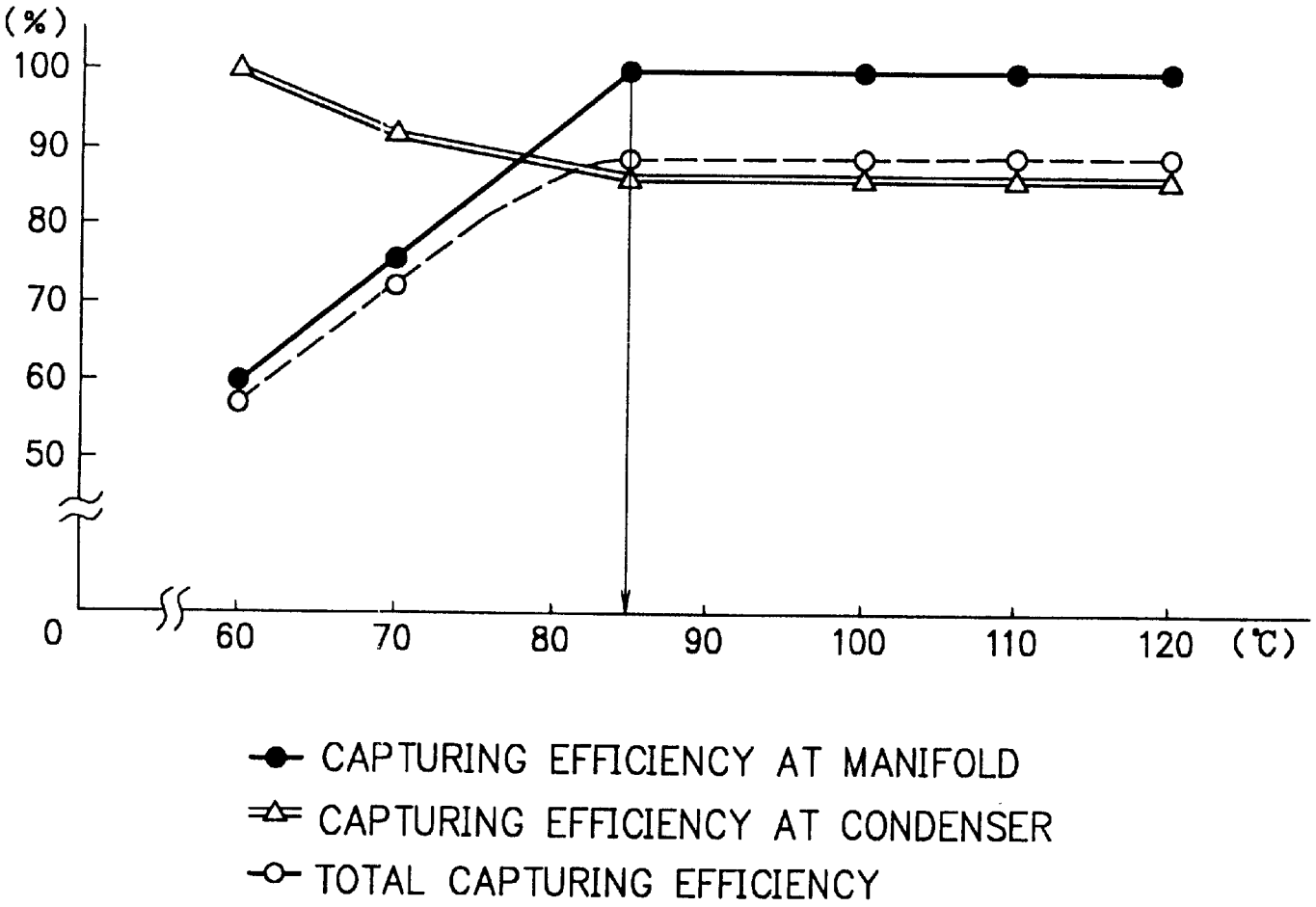
FIG. 6 is a graph showing a relation between the temperature of the regeneration roller and the capturing efficiency at the manifold, the capturing efficiency at the condenser, and the total capturing efficiency.

FIG. 6 is a graph showing a relation between the temperature of the regeneration roller 4 and the capturing efficiency at the manifold 5, the capturing efficiency at the condenser 7, and the total capturing efficiency, at the air flow quantity is 27 liters/minute. As shown in FIG. 6, in case that the air flow quantity is 27 liters/minute, the drying temperature becomes optimum at more than 85° C.

Next, the diameter and number of the first tubes 6 arc explained. The capturing efficiency is decided by the diameter and number of first tubes 6 and the air flow quantity. In case that the diameter of the first tubes 6 is too small, the capturing capacity becomes small and the squash of the first tubes 6 occurs. And in case that the diameter of the first tubes 6 is too large, the flow velocity becomes low. In case that the number of tubes is too many, the flow velocity in each tube becomes low, and in case that the number of tubes is only a few, the capturing capacity becomes low. The air flow quantity Qc is a function of the diameter of tubes Dt, the number of tubes Nt, and the power of the air pump Ip and is shown in an equation (2). The capturing efficiency 10 is increased by optimizing these factors.

$$Qc=f(Dt,Nt,Ip) \quad (2)$$

Figure 7:
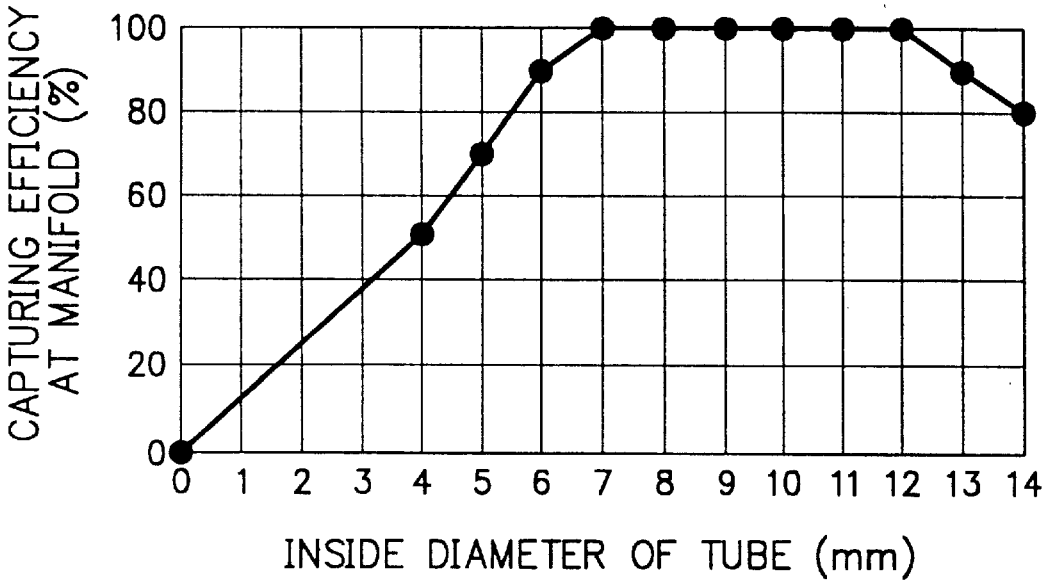
FIG. 7 is a graph showing a relation between the inside diameter of the first tubes and the capturing efficiency at the manifold.

FIG. 7 is a graph showing a relation between the inside diameter of the first tubes 6 and the capturing efficiency at the manifold 5. In FIG. 7, the number of the first tubes 6 is 12 pieces, and the air flow quantity of the air pump 9 is 27 liters/minute. As shown in FIG. 7, the capturing efficiency at the manifold 5 can secure over 99% at the case that the inside diameter of the first tubes 6 is 7 to 12 mm.

Figure 8:
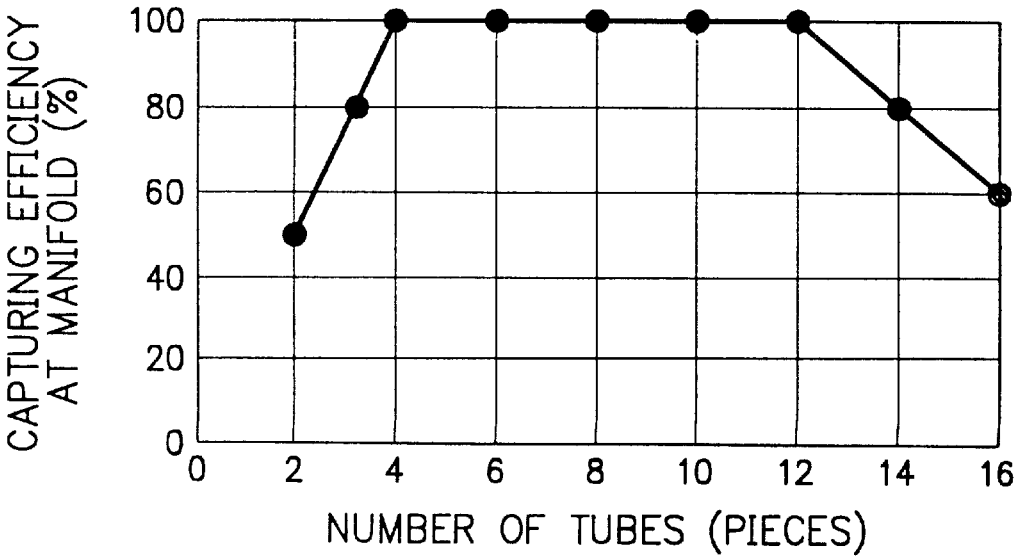
FIG. 8 is a graph showing a relation between the number of the first tubes and the capturing efficiency at the manifold.

FIG. 8 is a graph showing a relation between the number of the first tubes 6 and the capturing efficiency at the manifold 5. In FIG. 8, the inside diameter of the first tubes 6 is 10 mm, and the air flow quantity of the air pump 9 is 27 liters/minute. As shown in FIG. 8, the capturing efficiency at the manifold 5 can secure over 99% at the case that the number of the first tubes 6 is 4 to 12 pieces.

As mentioned above, the capturing efficiency at the manifold 5 can secure over 99% by that the inside diameter of first tubes 6, which leads the vapor generated in the manifold 5 to the condenser 7, is made to be 7 to 12 mm, and the number of first tubes 6 is made to be 4 to 12 pieces. As shown in FIG. 5 before, the total capturing efficiency can be achieved at the optimum conditions that the inside diameter of the first tubes 6 is 10 mm, the number of the first tubes 6 is 12 pieces, and the drying temperature is 85° C.

Figure 9:
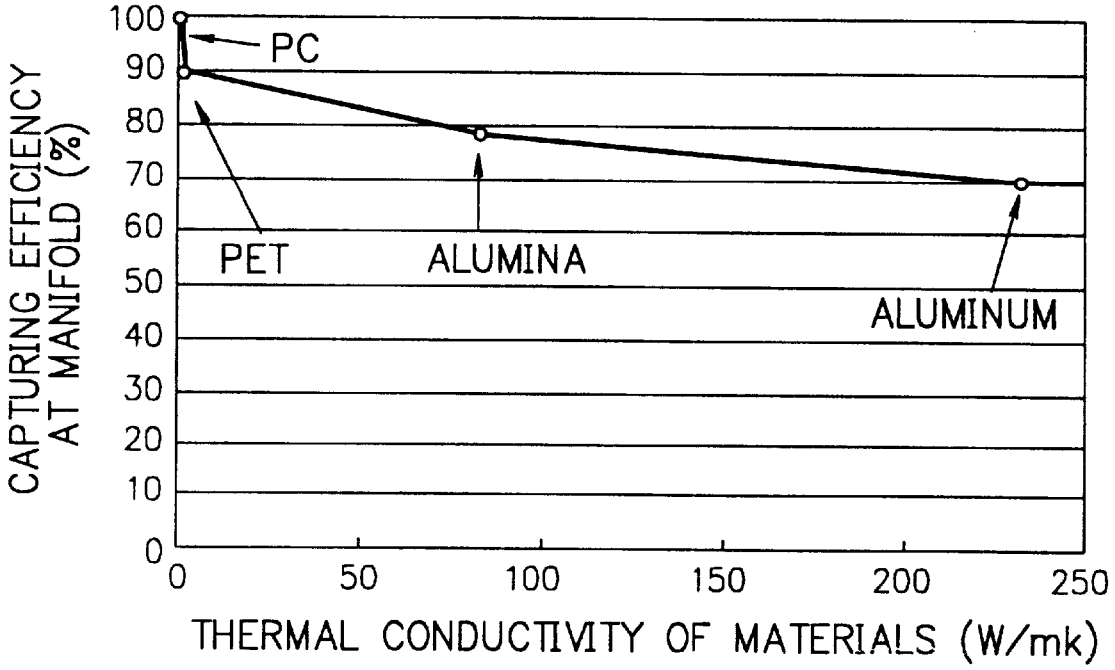
FIG. 9 is a graph showing a relation between materials used for the manifold and the capturing efficiency at the manifold.

Next, the material of the manifold 5 is explained. The amount of dew condensation to the inside wall is changed by the thermal conductivity of the material. And the capturing efficiency is changed by the material used. At the embodiment of the present invention, a heat resistant resin material such as polycarbonate (PC), polyethylene terephthalate (PET), whose thermal conductivity is lower than aluminum or alumina used in the conventional subsystem, is used. FIG. 9 is a graph showing a relation between materials used for the manifold 5 and the capturing efficiency at the manifold 5. As shown in FIG. 9, the capturing efficiency can be improved to over 99% by decreasing the amount of dew condensation to the inside wall of the manifold 5, because of the usage of PC or PET.

Next, the outlet structure of the manifold 5 is explained. Even when dew condensed on the wall of the manifold 5 caused by the change of surroundings, the condensed dew drops by its own weight in the structure shown in FIG. 3. Therefore, the capturing efficiency over 99% can be secured. In this, as shown in FIG. 3, the air outlet 14 of the manifold 5 must be constructed in a state that the air outlet 14 faces downward. With this structure, the condensed dew drops by its own weight.

In this case, the capacity of the air inlet 13 is made to be larger than that of the air inlet 12. With this structure, the pressure drop of the air passing through the air inlet 13 and the pressure drop of the air passing through the air inlet 12 become equal, and varying at the vapor capturing can be prevented. In this, the air flow quantity Qc is a function of the pressure drop Pd and the power of the air pump Ip, and is shown in an equation (3).

$$Qc=f(Pd,Ip) \quad (3)$$

Figure 10:
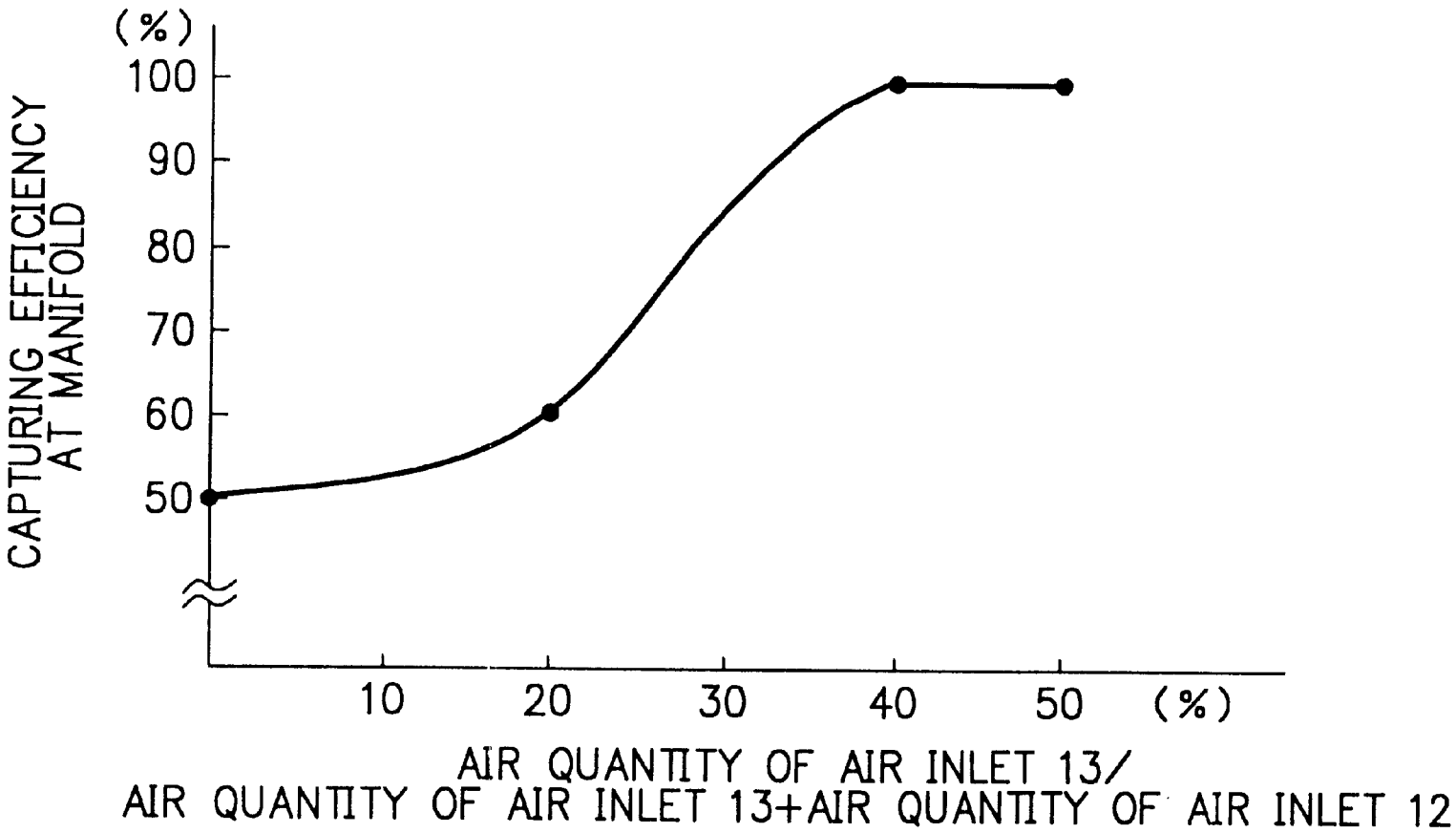
FIG. 10 is graph showing a relation between the capturing efficiency at the manifold and the ratio that the inputted air quantity of the upper air inlet is divided by the addition of the inputted air quantities of the upper and lower air inlets.

FIG. 10 is graph showing a relation between the capturing efficiency at the manifold 5 and the ratio that the inputted air quantity of the air inlet 13 is divided by the addition of the inputted air quantities of the air inlets 12 and 13. In FIG. 10, the air flow quantity at the air outlet 14 shown in FIG. 3 is fixed to 27 liters/minute. As shown in FIG. 10, by making the ratio of the air flow quantity of the air inlet 13 to the total air flow quantity 40 to 50%, the capturing efficiency over 99% at the manifold 5 can be secured. Making the ratio of the air flow quantity 40 to 50% means that the ratio of the pressure drop is made to be 40 to 50% of the total pressure drop.

As mentioned above, with the adjustment of the drying temperature at the regeneration roller 4, by improving the diameter and number of the first tubes 6, changing the material and structure of the manifold 5, and adjusting the ratio of the pressure drop at the air inlets 12 and 13, the dew condensation amount at the inside wall of the manifold 5 is made to be almost zero, and the manifold capturing efficiency is improved to be more than 99%, against that of the conventional manifold capturing efficiency of about 70%. And the condenser efficiency and the integrated total efficiency can be improved to be about 90%.

The embodiment mentioned above is a suitable embodiment applied to the present invention. And the present invention is not limited to the embodiment mentioned above and can be applied to other applications without departing from the spirit of the present invention. For example, the present invention can be applied to apparatuses, in which liquid is changed to vapor and the vapor is made to the liquid again, Such as a dry-cleaning apparatus. And the present invention can be applied to the apparatuses as an optimum means to improve the capturing efficiency.

As clearly mentioned above at the embodiment, the present invention adjusts the drying temperature at a regeneration roller, improves the diameter and number of tubes, changes the material and structure of a manifold, and adjusts the ratio of the pressure drop at air inlets. With these, the dew condensation amount on the inside wall of the manifold is made to be almost zero, and the manifold capturing efficiency is improved to be more than 99%, against that of the conventional manifold capturing efficiency of about 70%. And the capturing efficiency at the condenser and the integrated total efficiency can be improved to be about 90%.

And the manifold provides an opening part at the side where a ring shaped drying belt contacts with an organic photoconductor belt, and is provided in a state that a designated interval exists between the outside surface of the ring shaped drying belt and the inside surface of the manifold in order that routes in which outside air from the opening part passes through are provided, and the capacity of a first route provided on the outside surface of the upper side of the ring shaped drying belt is larger than the capacity of a second route provided on the outside surface of the lower side of the ring shaped drying belt. With this structure, the amount of vapor capturing can be prevented from varying. And the manifold has a structure that an air outlet, with which the vapor sucked by a sucking means is outputted, is provided vertically under the regeneration roller, therefore, even when the dew condensation occurs on the inside wall of the manifold, the condensed dew drops with its own weight.

While the present invention has been described with reference to the particular illustrative embodiments it is not to be restricted by those embodiments but only by the appended claims. It is to be appreciated that those skilled in the art can change or modify the embodiments without departing from the scope and spirit of the present invention.

What is claimed is:

1. A vapor capture subsystem, comprising:

an absorbing means for absorbing a carrier solvent in a developing material that is developed on the surface of an organic photoconductor belt by a developer;

a vaporizing means for vaporizing said carrier solvent absorbed at said absorbing means into a vapor;

a cooling means which captures said carrier solvent vaporized by said vaporizing means and makes said vaporized carrier solvent liquid by cooling;

tube components which lead said carrier solvent vaporized by said vaporizing means to said cooling means;

a sucking means which leads said carrier solvent vaporized by said vaporizing means to said cooling means; and a covering component which covers one end side of said absorbing means and said vaporizing means in order that said vapor generated by said vaporizing means does not leak to the outside, wherein a drying temperature of said vaporizing means is made to be 85° C. or more, and an air sucking quantity of said sucking means is 22 to 45 liters/minute.

2. A vapor capture subsystem in accordance with claim 1, wherein the air sucking quantity of said sucking means is 22 to 38 liters/minute.

3. A vapor capture subsystem in accordance with claim 1, wherein:

the number of said tube components is four to twelve pieces, and the inside diameter of said tube components is seven to twelve mm.

4. A vapor capture subsystem in accordance with claim 1, wherein:

said covering component is made of a heat-resistant resin material.

5. A vapor capture subsystem in accordance with claim 4, wherein:

said heat-resistant resin material is polycarbonate or polyethylene terephthalate.

6. A vapor capture subsystem in accordance with claim 1, wherein:

said absorbing means is a ring shaped drying belt whose one end contacts with said organic photoconductor belt;

said vaporizing means is a regeneration roller which is provided at the opposite side of the position where said ring shaped drying belt contacts with said organic photoconductor belt, and contacts with the inside surface of said ring shaped drying belt; and said covering component has an opening part at the side where said ring shaped drying belt contacts with said organic photoconductor belt, and is provided in a state that a designated interval exists between an outside surface of said ring shaped drying belt and an inside surface of said covering component in order that routes in which outside air from said opening part passes through are provided, and the capacity of a first route provided on the outside surface of the upper side of said ring shaped drying belt is larger than the capacity of a second route provided on the outside surface of the lower side of said ring shaped drying belt, wherein said covering component has an air outlet at a vertical under position of said regeneration roller, and said vapor sucked by said sucking means is outputted from said air outlet.

7. A vapor capture subsystem in accordance with claim 6, wherein:

said covering component is provided in a state that the ratio of inputting air quantity of said first route to the addition of the inputting air quantities of said first and second routes is 40 to 50%.

8. A vapor capture subsystem, comprising:

an absorbing means for absorbing a carrier solvent in a developing material that is developed on the surface of an organic photoconductor belt by a developer;

a vaporizing means for vaporizing said carrier solvent absorbed at said absorbing means into a vapor:

a cooling means which captures said carrier solvent vaporized by said vaporizing means and makes said vaporized carrier solvent liquid by cooling;

tube components which lead said carrier solvent vaporized by said vaporizing means to said cooling means;

a sucking means which leads said carrier solvent vaporized by said vaporizing means to said cooling means; and a covering component which covers one end side of said absorbing means and said vaporizing means in order that said vapor generated by said vaporizing means does not leak to the outside, wherein the number of said tube components is four to twelve pieces, and the inside diameter of said tube components is seven to twelve mm.

9. A vapor capture subsystem in accordance with claim 8, wherein:

said covering component is made of a heat-resistant resin material.

10. A vapor capture subsystem in accordance with claim 9, wherein:

said heat-resistant resin material is polycarbonate or polyethylene terephthalate.

11. A vapor capture subsystem in accordance with claim 8, wherein:

said absorbing means is a ring shaped drying belt whose one end contacts with said organic photoconductor belt;

said vaporizing means is a regeneration roller which is provided at the opposite side of the position where said ring shaped drying belt contacts with said organic photoconductor belt, and contacts with the inside surface of said ring shaped drying belt; and said covering component has an opening part at the side where said ring shaped drying belt contacts with said organic photoconductor belt, and is provided in a state that a designated interval exists between an outside surface of said ring shaped drying belt and an inside surface of said covering component in order that routes in which outside air from said opening part passes through are provided, and the capacity of a first route provided on the outside surface of the upper side of said ring shaped drying belt is larger than the capacity of a second route provided on the outside surface of the lower side of said ring shaped drying belt, wherein said covering component has an air outlet at a vertical under position of said regeneration roller, and said vapor sucked by said sucking means is outputted from said air outlet.

12. A vapor capture subsystem in accordance with claim 11, wherein:

said covering component is provided in a state that the ratio of inputting air quantity of said first route to the addition of the inputting air quantities of said first and second routes is 40 to 50%.

13. A vapor capture subsystem, comprising:

an absorbing means for absorbing a carrier solvent in a developing material that is developed on the surface of an organic photoconductor belt by a developer;

a vaporizing means for vaporizing said carrier solvent absorbed at said absorbing means into a vapor;

a cooling means which captures said carrier solvent vaporized by said vaporizing means and makes said vaporized carrier solvent liquid by cooling;

tube components which lead said carrier solvent vaporized by said vaporizing means to said cooling means;

a sucking means which leads said carrier solvent vaporized by said vaporizing means to said cooling means; and a covering component which covers one end side of said absorbing means and said vaporizing means in order that said vapor generated by said vaporizing means does not leak to the outside, wherein said covering component is made of a heat-resistant resin material.

14. A vapor capture subsystem in accordance with claim 13, wherein:

said heat-resistant resin material is polycarbonate or polyethylene terephthalate.

15. A vapor capture subsystem in accordance with claim 13, wherein:

said absorbing means is a ring shaped drying belt whose one end contacts with said organic photoconductor belt;

said vaporizing means is a regeneration roller which is provided at the opposite side of the position where said ring shaped drying belt contacts with said organic photoconductor belt, and contacts with the inside surface of said ring shaped drying belt; and said covering component has an opening part at the side where said ring shaped drying belt contacts with said organic photoconductor belt, and is provided in a state that a designated interval exists between an outside surface of said ring shaped drying belt and an inside surface of said covering component in order that routes in which outside air from said opening part passes through are provided, and the capacity of a first route provided on the outside surface of the upper side of said ring shaped drying belt is larger than the capacity of a second route provided on the outside surface of the lower side of said ring shaped drying belt, wherein said covering component has an air outlet at a vertical under position of said regeneration roller, and said vapor sucked by said sucking means is outputted from said air outlet.

16. A vapor capture subsystem in accordance with claim 15, wherein:

said covering component is provided in a state that the ratio of inputting air quantity of said first route to the addition of the inputting air quantities of said first and second routes is 40 to 50%.

17. A vapor capture subsystem, comprising:

a ring shaped drying belt whose one end contacts with an organic photoconductor belt, and absorbs a carrier solvent in a developing material that is developed on the surface of said organic photoconductor belt by a developer;

a regeneration roller which is provided at the opposite side of the position where said ring shaped drying belt contacts with said organic photoconductor belt, and contacts with the inside surface of said ring shaped drying belt, and makes said carrier solvent absorbed at said ring shaped drying belt vapor;

a condenser which captures said carrier solvent vaporized at said regeneration roller and makes said vaporized carrier solvent liquid by cooling;

tubes which lead said carrier solvent vaporized at said regeneration roller to said condenser;

an air pump which leads said carrier solvent vaporized at said regeneration roller to said condenser; and a manifold which has an opening part at the side where said ring shaped drying belt contacts with said organic photoconductor belt, and is provided in a state that a designated interval exists between an outside surface of said ring shaped drying belt and an inside surface of said manifold in order that routes in which outside air from said opening part passes through arc provided, and the capacity of a first route provided on the outside surface of the upper side of said ring shaped drying belt is larger than the capacity of a second route provided on the outside surface of the lower side of said ring shaped drying belt, wherein said manifold has an air outlet at a vertical under position of said regeneration roller, and said vapor sucked by said air pump is outputted from said air outlet.

18. A vapor capture subsystem in accordance with claim 17, wherein:

said manifold is provided in a state that the ratio of inputting air quantity of said first route to the addition of the inputting air quantities of said first and second routes is 40 to 50%.

19. A vapor capture method in an image forming apparatus, the method comprising:

absorbing a carrier solvent in a developing material that is developed on the surface of an organic photoconductor belt by a developer;

vaporizing said carrier solvent absorbed at said absorbing step;

sucking said carrier solvent vaporized at said vaporizing step and leading to a cooling step; and cooling said vaporized carrier solvent sucked at said sticking step and making said vaporized carrier solvent liquid by cooling, wherein a drying temperature of said vaporizing step is made to be 85° C. or more, and an air sucking quantity of said sucking step is 22 to 45 liters/minute.

20. A vapor capture method in an image forming apparatus in accordance with claim 19, wherein the air sucking quantity of said sucking step is 22 to 38 liters/minute.

21. A vapor capture method in an image forming apparatus in accordance with claim 19, wherein the number and the inside diameter of tube components, which lead said carrier solvent vaporized at said vaporizing step to said cooling step, is four to twelve pieces and seven to twelve mm respectively.

22. A vapor capture method in an image forming apparatus, the method comprising:

absorbing a carrier solvent in a developing material that is developed on the surface of an organic photoconductor belt by a developer;

vaporing said carrier solvent absorbed at said absorbing step;

sucking said carrier solvent vaporized at said vaporizing step and leading to a cooling step; and cooling said vaporized carrier solvent sucked at said sucking step and making said vaporized carrier solvent liquid by cooling, wherein the number and the inside diameter of tube components, which lead said carrier solvent vaporized at said vaporizing step to said cooling step, is four to twelve pieces and seven to twelve mm respectively.

23. A vapor capture subsystem for use in an image forming apparatus having a carrier solvent in a developing material that is developed on the surface of an organic photoconductor belt by a developer, the vapor capture subsystem comprising:

an absorber that absorbs the carrier solvent in the developing material;

a vaporizer that vaporizes the absorbed carrier solvent into a vapor, the vaporizer having a drying temperature of about 85° C. or more;

a cooling element that cools the vapor into a liquid;

one or more tube components that connect the vaporizer to the cooling element;

a suction device that cooperates with the one or more tube components to transport the vapor to the cooling element at a rate of about 22 to about 45 liters/minute; and a cover that covers one side of the absorber and the vaporizer such that the vapor is contained within the cover.

24. A vapor capture subsystem in accordance with claim 23, wherein the rate that the suction device transports the vapor to the cooling element is about 22 to about 38 liters/minute.

25. A vapor capture subsystem in accordance with claim 23, wherein the number of the one or more tube components is four to twelve, and the tube components have an inside diameter of about 7 mm to about 12 mm.

26. A vapor capture subsystem in accordance with claim 23, wherein the cover is made of a heat-resistant resin material.

27. A vapor capture subsystem in accordance with claim 26, wherein the heat-resistant resin material is polycarbonate or polyethylene terephthalate.

28. A vapor capture subsystem in accordance with claim 23, wherein:

the absorber is a ring shaped drying belt having an inner surface and an outer surface, the outer surface contacting the organic photoconductor belt;

the vaporizer is a regeneration roller that contacts the inner surface of the ring shaped drying belt at a location opposite that of the contact between the outer surface of the ring shaped drying belt and the organic photoconductor belt; and the cover having an opening at the side thereof where the ring shaped drying belt contacts with the organic photoconductor belt such that air may enter, the cover being spaced from the outer surface of the ring shaped drying belt such that a first air route is provided above the outer surface of the ring shaped drying belt and a second air route is provided below the outer surface of the ring shaped drying belt, and the cover having a vertical air outlet located below the regeneration roller, the vapor being output from the air outlet by the suction device.

29. A vapor capture subsystem in accordance with claim 28, wherein the first air route has a larger capacity than the second air route.

30. A vapor capture subsystem in accordance with claim 28, wherein the cover is spaced from the outer surface of the ring shaped drying belt such that a ratio between the quantity of air input through the opening to the first air route compared to the quantity of air input to the first and second air routes together is about 40 to about 50%.

31. A vapor capture subsystem for use in an image forming apparatus having a carrier solvent in a developing material that is developed on the surface of an organic photoconductor belt by a developer, the vapor capture subsystem comprising:

an absorber that absorbs the carrier solvent in the developing material;

a vaporizer that vaporizes the absorbed carrier solvent into a vapor;

a cooling element that cools the vapor into a liquid;

four to twelve tube components that connect the vaporizer to the cooling element, the tube components having an inside diameter of about 7 mm to about 12 mm;

a suction device that cooperates with the tube components to transport the vapor to the cooling element; and a cover that covers one side of the absorber and the vaporizer such that the vapor is contained within the cover.

32. A vapor capture subsystem in accordance with claim 31, wherein the cover is made of a heat-resistant resin material.

33. A vapor capture subsystem in accordance with claim 32, wherein the heat-resistant resin material is polycarbonate or polyethylene terephthalate.

34. A vapor capture subsystem in accordance with claim 31, wherein:

the absorber is a ring shaped drying belt having an inner surface and an outer surface, the outer surface contacting the organic photoconductor belt;

the vaporizer is a regeneration roller that contacts the inner surface of the ring shaped drying belt at a location opposite that of the contact between the outer surface of the ring shaped drying belt and the organic photoconductor belt; and the cover having an opening at the side thereof where the ring shaped drying belt contacts with the organic photoconductor belt such that air may enter, the cover being spaced from the outer surface of the ring shaped drying belt such that a first air route is provided above the outer surface of the ring shaped drying belt and a second air route is provided below the outer surface of the ring shaped drying belt, and the cover having a vertical air outlet located below the regeneration roller, the vapor being output from the air outlet by the suction device.

35. A vapor capture subsystem in accordance with claim 34, wherein the first air route has a larger capacity than the second air route.

36. A vapor capture subsystem in accordance with claim 34, wherein the cover is spaced from the outer surface of the ring shaped drying belt such that a ratio between the quantity of air input through the opening to the first air route compared to the quantity of air input to the first and second air routes together is about 40 to about 50%.

37. A vapor capture subsystem for use in an image forming apparatus having a carrier solvent in a developing material that is developed on the surface of an organic photoconductor belt by a developer, the vapor capture subsystem comprising:

an absorber that absorbs the carrier solvent in the developing material;

a vaporizer that vaporizes the absorbed carrier solvent into a vapor;

a cooling clement that cools the vapor into a liquid;

one or more tube components that connect the vaporizer to the cooling clement;

a suction device that cooperates with the one or more tube components to transport the vapor to the cooling clement; and a heat-resistant resin cover that covers one side of the absorber and the vaporizer such that the vapor is contained within the cover.

38. A vapor capture subsystem in accordance with claim 37, wherein the heat-resistant resin cover is polycarbonate or polyethylene terephthalate.

39. A vapor capture subsystem in accordance with claim 37, wherein:

the absorber is a ring shaped drying belt having an inner surface and an outer surface, the outer surface contacting the organic photoconductor belt;

the vaporizer is a regeneration roller that contacts the inner surface of the ring shaped drying belt at a location opposite that of the contact between the outer surface of the ring shaped drying belt and the organic photoconductor belt; and the cover having an opening at the side thereof where the ring shaped drying belt contacts with the organic photoconductor belt such that air may enter, the cover being spaced from the outer surface of the ring shaped drying belt such that a first air route is provided above the outer surface of the ring shaped drying belt and a second air route is provided below the outer surface of the ring shaped drying belt, and the cover having a vertical air outlet located below the regeneration roller, the vapor being output from the air outlet by the suction device.

40. A vapor capture subsystem in accordance with claim 39, wherein the first air route has a larger capacity than the second air route.

41. A vapor capture subsystem in accordance with claim 39, wherein the cover is spaced from the outer surface of the ring shaped drying belt such that a ratio between the quantity of air input through the opening to the first air route compared to the quantity of air input to the first and second air routes together is about 40 to about 50%.

42. A vapor capture subsystem for use in an image forming apparatus having a carrier solvent in a developing material that is developed on the surface of an organic photoconductor belt by a developer, the vapor capture subsystem comprising:

a ring shaped drying belt that absorbs the carrier solvent in the developing material, the ring shaped drying belt having an inner surface and an outer surface, the outer surface contacting the organic photoconductor belt;

a regeneration roller that vaporizes the absorbed carrier solvent into a vapor and contacts the inner surface of the ring shaped drying belt at a location opposite that of the contact between the outer surface of the ring shaped drying belt and the organic photoconductor belt;

a condenser that captures the vapor and converts the vapor into a liquid;

tubes that connect the regeneration roller to the condenser;

an air pump that cooperates with the tubes to transport the vapor to the condenser; and a manifold that covers the ring shaped drying belt and the regeneration roller such that the vapor is contained within the manifold, the manifold having an opening at the side thereof where the ring shaped drying belt contacts with the organic photoconductor belt such that air may enter the manifold, the manifold being spaced from the outer surface of the ring shaped drying belt such that a first air route is provided from the opening and above the outer surface of the ring shaped drying belt and a second air route is provided from the opening and below the outer surface of the ring shaped drying belt, the manifold having a vertical air outlet located below the regeneration roller, the vapor being output from the air outlet by the air pump.

43. A vapor capture subsystem in accordance with claim 42, wherein the first air route has a larger capacity than the second air route.

44. A vapor capture subsystem in accordance with claim 42, wherein the manifold is spaced from the outer surface of the ring shaped drying belt such that a ratio between the quantity of air input through the opening to the first air route compared to the quantity of air input to the first and second air routes together is about 40 to about 50%.

* * * * *